United States Patent [19]

Kielman et al.

[11] Patent Number: 4,620,936

[45] Date of Patent: Nov. 4, 1986

[54] MACHINE-DISHWASHING COMPOSITIONS

[75] Inventors: Hendrik S. Kielman, Maassluis; Jan S. Bongers, Vlaardingen, both of Netherlands

[73] Assignee: Lever Brothers Company, New York, N.Y.

[21] Appl. No.: 638,131

[22] Filed: Aug. 6, 1984

[30] Foreign Application Priority Data

Aug. 15, 1983 [GB] United Kingdom ..... 8321923

[51] Int. Cl.[4] ..... C11D 7/18; C11D 7/42; C11D 7/56

[52] U.S. Cl. ..... 252/99; 252/102; 252/103; 252/174.12; 252/186.29; 252/186.31; 252/DIG. 12

[58] Field of Search ..... 252/99, 174.12, DIG. 12

[56] References Cited

U.S. PATENT DOCUMENTS

| | | | |
|---|---|---|---|
| 3,637,339 | 1/1972 | Gray | 8/111 |
| 3,799,879 | 3/1974 | Francke et al. | 252/174.12 |
| 3,960,665 | 6/1976 | Villadsen et al. | 252/99 X |
| 4,003,700 | 1/1977 | Gray | 8/111 |
| 4,021,360 | 5/1977 | McLaughlin et al. | 252/99 |
| 4,088,595 | 5/1978 | Michelson et al. | 252/95 |
| 4,115,292 | 9/1978 | Richardson et al. | 252/90 |
| 4,162,987 | 7/1979 | Maguire et al. | 252/135 |
| 4,501,681 | 2/1985 | Groult et al. | 252/174.12 |
| 4,547,305 | 10/1985 | Cornelissen et al. | 252/94 |
| 4,568,476 | 2/1986 | Kielman et al. | 252/95 |

FOREIGN PATENT DOCUMENTS

| | | |
|---|---|---|
| 2650429 | 5/1977 | Fed. Rep. of Germany . |
| 2116198 | 9/1983 | United Kingdom . |

*Primary Examiner*—Prince E. Willis

*Attorney, Agent, or Firm*—Milton L. Honig; James J. Farrell

[57] ABSTRACT

A mildly alkaline enzymatic detergent cleaning composition adapted for use in automatic dishwashing machines comprising (a) an amylolytic enzyme, (b) sodium triphosphate, (c) sodium carbonate and/or borax, (d) sodium silicate, (e) a peroxy compound bleach, (f) a stabilizing agent, and optionally but preferably (g) a proteolytic enzyme and/or (n) a low- to non-foaming nonionic surfactant and/or (i) a fatty acid having chain length of about 12–18 carbon atoms, the amounts of components (b), (c) and (d) being so adjusted that the composition will have sufficent builder and buffering capacity to maintain a solution-pH of from 9.3 to 10.8. The composition presented in the form of a particulate product is an effective machine dishwashing composition comparable to conventional highly alkaline chlorine bleach-containing products.

9 Claims, No Drawings

MACHINE-DISHWASHING COMPOSITIONS

This invention relates to detergent cleaning compositions which are particularly suitable for use in automatic dishwashing machines.

Conventional automatic dishwashing compositions are highly alkaline products comprising a chlorine-containing bleach having a solution pH generally above 11.5. Though performance-wise these conventional detergent compositions are quite satisfactory, they have some serious drawbacks in other respects. Highly alkaline compositions have the disadvantage of being hazardous and the incorporation of chlorine bleaches, though effective for stain removal, requires special processing and storage precautions to protect the composition components which are subject to deterioration upon direct contact with the active chlorine. The stability of the chlorine bleach is also critical and raises additional processing and storage difficulties. A further disadvantage is the difficulty of dyeing and perfuming of such compositions due to the instability of dyes and perfumes towards chlorine.

It is an object of the present invention to provide an at least equally effective detergent cleaning composition which does not have the above disadvantages or at least mitigates the above disadvantages to a substantial degree.

The detergent cleaning composition of the invention is a mildly alkaline composition having a solution pH of from about 9.3 to about 10.8 and comprises an amylolytic enzyme and a peroxy compound bleach.

By solution pH it is meant here the pH as determined from a solution of 3 g/l of the composition in distilled water.

An upper pH level of about 10.8 is chosen so as to ensure a mildly alkaline composition having a solution pH of not more than 11.0.

Enzyme-containing machine-dishwashing compositions have been proposed by various investigators in the art, but have never achieved the commercial stage. The difficulties in formulating such cleaning compositions are mainly lying in the instability of the enzymes under highly alkaline conditions and/or the incompatibility of the enzymes with the bleaching agent. Various attempts have been proposed to solve these problems, so far without success.

So, U.S. Pat. No. 3,799,879 teaches detergent compositions for cleaning dishes, containing sodium perborate, an amylolytic enzyme and in addition optionally a proteolytic enzyme, the detergent composition having a solution pH of from 7 to 9. These compositions, however, are deficient in performance due to their alkalinity being too low to effect good cleaning action.

U.S. Pat. No. 4,162,987 teaches an enzymatic automatic dishwashing composition having a pH in use of from about 8.5–11.5, preferably from 9.5–10.5. The composition of this reference, however, does not contain a bleaching agent and contains a relatively high proportion of nonionic surfactant possibly with the purpose of compensating the absence of a bleaching agent. However, also this composition of the art is far from ideal for matching the performance of conventional highly alkaline/chlorine bleach compositions.

It has now been found that the formulation of an effective and stable, mildly alkaline, enzymatic, automatic dishwashing detergent composition is a matter of choosing the correct ingredients and a proper balance between enzyme activity, adequate builder and buffering capacity, bleaching action and surfactant content, combined with a suitable type of bleaching agent.

Accordingly, the invention provides an effective and stable enzymatic detergent cleaning composition adapted for use in automatic dishwashing machines, comprising an amylolytic enzyme and a peroxy compound bleaching agent which is characterized in that it comprises:

(a) from 0.2 to 5% by weight of an amylolytic enzyme such that the final composition has amylolytic activity of from $10^3$ to $10^6$ Maltose Units/kg (b) from 25 to 50% by weight of sodium triphosphate;

(c) from 7.5 to 40%, preferably 10–35% by weight of sodium carbonate and/or borax;

(d) from 2 to 15% by weight of sodium silicate, having $SiO_2$:$Na_2O$ ratio of from 1:1 to 4:1, preferably from 1.5:1 to 3:1;

(e) from 5 to 25% by weight of a peroxy compound bleach selected from the group of solid peroxy acids and their salts; and mixtures of a solid hydrogen peroxide adduct with an activator wherein the ratio by weight of said hydrogen peroxide adduct to activator is within the range of from 8:1 to 1:1, preferably 4:1 to 1.5:1;

(f) from 0.05 to 1% by weight of a stabilizing agent for the bleaching agent; and optionally but preferably (g) from 0.2 to 5% by weight of a proteolytic enzyme such that the final composition has proteolytic enzyme activity of from $10^6$ to $10^8$ Glycine Units/kg; and/or (h) from 0.1 to 5% by weight of a low- to non-foaming nonionic surfactant; and/or (i) from 0.5 to 5% by weight of a fatty acid having a chain length of about 12–18 carbon atoms, the amounts of components (b), (c) and (d) being so adjusted that the composition will have sufficient builder and buffering capacity to maintain a solution pH of from 9.3–10.8, preferably from 9.5–10.5.

A preferred builder/buffer mixture is sodium triphosphate, sodium carbonate and sodium disilicate ($SiO_2$:-$Na_2O$ ratio from 2:01 to 2.5:1).

The amylolytic enzymes [component (a)] for use in the present invention can be those derived from bacteria or fungi. Preferred amylolytic enzymes are those prepared and described in British Patent Specification No. 1 296 839, cultivated from the strains of *Bacillus licheniformis* NCIB 8061, NCIB 8059, ATCC 6334, ATCC 6598, ATCC 11 945, ATCC 8480 and ATCC 9945 A. A particularly preferred amylolytic enzyme is an amylolytic enzyme produced and distributed under the trade name SP-95 ® or Termamyl ® by Novo Industri A/S, Copenhagen, Denmark. These amylolytic enzymes are generally presented as granules and may have enzyme activities of from about 2 to 10 Maltose units/milligram. The amylolytic activity can be determined by the method described by P. Bernfeld in "Method of Enzymology", Volume I (1955), page 149.

As the solid peroxyacid (compound (e)), any organic peracid as described in European Patent Applications Nos. 0 027 146 and No. 0 027 693 can be used. A preferred solid organic peracid is monoperoxyphthalic acid, which can be used in the form of its magnesium salt having the formula:

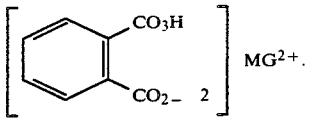

Another type of solid peroxyacid is the class of inorganic persulphates of which potassium monopersulphate is the most common representative.

Examples of solid hydrogen peroxide adducts which can be used together with an activator in the present invention are the alkali metal perborates (mono- or tetrahydrate), percarbonates and persilicates. Preferred hydrogen peroxide adducts are sodium perborate and sodium percarbonate.

The activators for percompounds which are used in the present invention are organic compounds which react with the hydrogen peroxide adduct in solution to form an organic peracid, as the effective bleaching species. Numerous examples of activators of this type, often referred to as bleach or peracid precursors, are known in the art. Preferred activators for use in the present invention are tetraacetylethylene diamine (TAED), tetraacetylglycoluril (TAGU), glucose pentaacetate (GPA) and xylose tetraacetate (XTA).

Other suitable activators or peracid precursors are described for example in British Pat. Nos. 836,988; 855,735 and 907,356; U.S. Pat. Nos. 1,246,339; 3,332,882 and 4,128,494; Canadian Pat. No. 844,481 and in a series of articles by Allan H. Gilbert in Detergent Age, June 1967, pages 18–20, July 1967, pages 30–33, and August 1967, pages 26, 27 and 67.

Stabilizing agents [component (f)] which can be used herein are ethylene diamine tetraacetate (EDTA) or the compounds as disclosed in EP 0 037 146.

Preferred stabilizing agents are ethylene diamine tetra-(methylene phosphonic acid) and diethylene triamine penta-(methylene phosphonic acid) or their water-soluble salts. They may be added as such or in the form of their Calcium, Magnesium, Aluminium or Zinc Complexes as described in U.S. Pat. No. 4,259,200; especially their Calcium Complexes are particularly suitable.

As explained, the composition of the invention may further and preferably contain a proteolytic enzyme [compound (g)]. Examples of suitable proteolytic enzymes are the subtilisins which are obtained from particular strains of *B. subtilis* and *B. licheniformis*, such as the commercially available subtilisins Maxatase ®, supplied by Gist-Brocades N.V., Delft, Holland, and Alcalase ®, supplied by Novo Industri A/S, Copenhagen, Denmark. Particularly suitable is a protease obtained from a strain of Bacillus having maximum activity throughout the pH-range of 8–12, being commercially available from Novo Industri A/S under the registered trade-names of Esperase ® and Savinase ®. The preparation of these and analogous enzymes is described in British Pat. No. 1 243 784.

These enzymes are generally presented as granules, e.g. marumes, prills, T-granulates etc, and may have enzyme activities of from about 500 to 1700 glycine units/ milligram. The proteolytic activity can be determined by the method as described by M. L. Anson in "Journal of General Physiology", Vol. 22 (1938), page 79. The relationship between an Anson Unit and a glycine unit is that one Anson Unit/g = 733 glycine units/-milligram.

A small amount of low to non-foaming nonionic surfactant which includes any alkoxylated nonionic surfaceactive agent wherein the alkoxy moiety is selected from the group consisting of ethylene oxide, propylene oxide and mixtures thereof, is preferably used to improve the detergency and to suppress excessive foaming due to some protein soil. However, an excessive proportion of nonionic surfactant should be avoided.

Examples of suitable and preferred low to non-foaming nonionic surfactants for use in the invention are the ethoxylated straight chain alcohols sold under the trade-names of Plurafac ® RA 30 and Plurafac ®RA 40 by the Eurane Company, Lutensol ® LF 403 and Lutensol ® LF 1300 by the BASF Company, and Triton ® DF 12 by the Rohm & Haas Company.

A fatty acid is preferably used when formulations are prepared having a pH in the lower range of between 9.3 and 10. Low pH formulations tend to cause silver tarnishing as opposed to higher pH formulations. The addition of a small amount of a fatty acid having a chain length of $C_{12}$–$C_{18}$ is an effective means to solve this problem. In addition thereto or in replacement thereof other corrosion inhibitors known to prevent silver tarnishing, such as Benzotriazole, may also be used.

Finally, the addition of an inert filler may be required to complete the composition. A preferred filler is sodium sulphate.

The detergent cleaning composition of the invention will generally be presented in the form of a dry particulate product, which may be prepared by the conventional route of dry mixing the particulate or granular components, followed by spraying the liquid ingredients, if present, such as a nonionic surfactant, on to said mixture.

The invention will now be illustrated by the following Examples.

EXAMPLES I–V

The following compositions of the invention were prepared by dry mixing all the components in a given proportional ratio, except for the liquid nonionic surfactant which was added as the last component on to said particulate mixture. Following the nonionic addition, the products were weathered during an additional mixing of 3 minutes.

| Composition (% by weight) | I | II | III | IV | V |
|---|---|---|---|---|---|
| Sodium carbonate | 35.0 | 10.0 | — | 15.0 | 15.0 |
| Borax | — | — | 15.0 | — | — |
| Sodium triphosphate | 28.2 | 40.0 | 35.0 | 45.0 | 45.0 |
| Amylase (Termamyl ®) (3.8 MU/mg) | 0.3 | 1.0 | 1.0 | 3.0 | 3.0 |
| Proteolytic enzyme (Alcalase ®) (1100 GU/mg) | — | 1.0 | 1.0 | — | — |
| Proteolytic enzyme Esperase ®) (657 GU mg) | — | — | — | 2.0 | 2.0 |
| TAED (activator) | 2.0 | 2.0 | 2.0 | 4.0 | 4.0 |
| Sodium perborate tetrahydrate | 5.0 | 15.0 | 6.0 | 10.0 | 10.0 |
| EDTMP (stabilizer) | 0.2 | 0.4 | 0.2 | 0.7 | — |
| EDTA (stabilizer) | — | — | — | — | 0.7 |
| Sodium disilicate ($SiO_2/Na_2O$ = 2.4) | 12.0 | 12.0 | 10.0 | 5.0 | 5.0 |
| Alkaline silicate | 0.5 | — | — | — | — |
| Sodium sulphate | 15.2 | 10.0 | 27.0 | 10.0 | 10.0 |
| Nonionic surfactant (Plurafac ® RA 40) | 1.5 | 1.5 | — | 1.5 | 1.5 |
| Water | | | up to 100 | | |
| pH | 10.8 | 10.6 | 9.7 | 10.5 | 10.5 |

The products were packed in closed 1 kg white carton packs and stored at 20°-22° C./50-60% relative humidity for 2 months. No substantial deterioration in activity of the major active components amylase, proteolytic enzyme, activator, perborate and stabilizer was detected.

EXAMPLE VI

A product composition IV of the invention was tested in two types of dishwashing machines against a standard commercial highly alkaline machine dishwashing product (S) containing a chlorine bleach of the following composition:

| | |
|---|---|
| Sodium triphosphate | 36% |
| Sodium metasilicate | 61% |
| Potassium dichlorocyanurate (KDCCA) | 2.0% |
| Nonionic surfactant | 1.0 |

DESIGN

The evaluation was focussed on normal dosage and wash conditions. In each machine besides monitors, articles soiled with daily canteen soil were present.

Machines: Indesit ® - Philips ®

Programmes:

Indesit normal cycle (1 prerinse, main wash 65° C., 2 intermediate rinses, 1 final rinse 65° C. Water intake: 11.5-12 liter in the main wash Philips normal cycle (main wash 65° C., 1 intermediate rinse, 1 final rinse 65° C. Water intake 11.7-11.9 liter in the main wash.

Water hardness in the machine:

Indesit: main wash 22° French Hardness, final rinse 26° French Hardness

Philips: main wash 15° French Hardness

Rinse aid: 2 ml

Repeats : 6 in the Philips, 4 in the Indesit

Dosage : 30 ml composition IV, 30 ml commercial product S.

pH-Measurements of the Main Wash Liquors

The measured pH's are: 9.8-9.9 with composition IV and 11.4-11.5 with commercial product S.

The results of single wash tests and after 6 (six) washes are tabulated below:

TABLE

| SINGLE WASH RESULTS | Philips IV | Philips S | Indesit IV | Indesit S |
|---|---|---|---|---|
| | % articles clean | | | |
| Soiling | | | | |
| Canteen | 95 | 85 | 98 | 89 |
| Monitors | | | | |
| Lipstick | 100 | 100 | — | — |
| Tea | 100 | 0 | 100 | 50 |
| Egg | 0 | 0 | 0 | 0 |
| Fat | 100 | 100 | 100 | 88 |
| Starch % removed | 100 | 43 | — | — |
| Redeposition | 100 | 100 | — | — |
| Glasses | | | | |
| Film | | | | |
| (clean) | 4 | 0 | 0 | 0 |
| (acceptable) | 95 | 71 | 100 | 88 |
| Spots | | | | |
| (clean) | 0 | 0 | 0 | 0 |
| (acceptable) | 79 | 95 | 100 | 88 |
| Standard | | | | |
| Lipstick (clean) | 100 | 42 | 100 | 100 |
| Milk (clean) | 100 | 46 | 100 | 75 |
| Tea (clean) | 100 | 42 | 100 | 100 |
| Cheese (clean) | 100 | 100 | 100 | 100 |
| Egg (clean) | 100 | 100 | 100 | 100 |

TABLE-continued

| SINGLE WASH RESULTS | Philips IV | Philips S | Indesit IV | Indesit S |
|---|---|---|---|---|
| | % articles clean | | | |
| Fat (clean) | 100 | 50 | 88 | 75 |
| Starch (clean) | 89 | 47 | 99 | 81 |
| Results after 6 washes | | | | |
| Starch 0-5% rest soil | 100 | 0 | — | — |
| Redeposition score 0 | 75 | 50 | — | — |
| Glasses | | | | |
| Film acceptable | 100 | 15 | — | — |
| Spots acceptable | 95 | 60 | — | — |

The above results show a clear superiorty of Composition IV of the invention over a standard commercial highly alkaline chlorine bleach containing product on substantially all aspects under the test conditions as applied.

We claim:

1. Detergent cleaning composition adapted for use in automatic dishwashing machines comprising:
   (a) from 0.2 to 5% by weight of an amylolytic enzyme such that the final composition has amylolytic activity of from $10^3$ to $10^6$ Maltose Units/kg;
   (b) from 25 to 50% by weight of sodium triphosphate;
   (c) from 7.5 to 40% by weight of sodium carbonate and/or borax;
   (d) from 2 to 15% by weight of sodium silicate, having $SiO_2 : Na_2O$ ratio of from 1:1 to 4:1;
   (e) from 5 to 25% by weight of a peroxy compound bleach selected from the group of solid peroxy acids and their salts; and mixtures of a solid hydrogen peroxide adduct with an activator wherein the ratio by weight of said hydrogen peroxide adduct to activator is within the range of from 8:1 to 1:1; and
   (f) from 0.05 to 1% by weight of a stabilizing agent for the bleaching agent;

the amounts of components (b), (c) and (d) being so adjusted that the composition will have sufficient builder and buffering capacity to maintain a solution pH of from 9.3-10.8.

2. Detergent cleaning composition according to claim 1, which further comprises from 0.2 to 5% by weight of a proteolytic enzyme such that the final composition has proteolytic enzyme activity of from $10^6$ to $10^8$ Glycine Units/kg.

3. Detergent cleaning composition according to claim 1 which further comprises from 0.1 to 5% by weight of a low to non-foaming nonionic surfactant.

4. Detergent cleaning composition according to claim 1, which further comprises from 0.5 to 5% by weight of a fatty acid having a chain length of about 12-18 carbon atoms.

5. Detergent cleaning composition according to claim 1, which comprises from 10 to 35% by weight of sodium carbonate and/or borax.

6. Detergent cleaning composition according to claim 2, wherein said proteolytic enzyme is a protease obtained from a strain of Bacillus having maximum activity throughout the pH-range of 8-12.

7. Detergent cleaning composition according to claim 1, wherein said activator is selected from tetraacetyl ethylene diamine (TAED), tetraacetylglycoluril (TAGU), glucose pentaacetate (GPA) and xylosetetraacetate (XTA) and mixtures thereof.

8. Detergent cleaning composition according to claim 1, wherein said stabilizing agent for the bleaching agent is selected from ethylene diamine tetra(methylene phosphonic acid), diethylene triamine penta(methylene phosphonic acid), their water-soluble salts and their complexes with Calcium, Magnesium, Aluminium or Zinc.

9. Detergent cleaning composition according to claim 1, having a solution pH of from 9.5 to 10.5.

* * * * *